US005842880A

United States Patent [19]

Pei

[11] Patent Number: 5,842,880

[45] Date of Patent: Dec. 1, 1998

[54] LOCKING DEVICE FOR USE WITH CARD EDGE CONNECTOR

[75] Inventor: Wen-Chun Pei, Taipei, Taiwan

[73] Assignee: Hon Hai Precision Ind. Co., Ltd., Taipei Hsien, Taiwan

[21] Appl. No.: 745,099

[22] Filed: Nov. 7, 1996

[51] Int. Cl.[6] ..... H01R 13/62

[52] U.S. Cl. ..... 439/327

[58] Field of Search ..... 439/327–329, 439/629–631, 637, 157, 156

[56] References Cited

U.S. PATENT DOCUMENTS

| | | | |
|---|---|---|---|
| 3,550,062 | 12/1970 | Drenten et al. | 439/327 |
| 3,853,379 | 12/1974 | Goodman et al. | 439/328 |
| 5,417,580 | 5/1995 | Tsai | 439/328 |
| 5,650,917 | 7/1997 | Hsu | 439/327 |

*Primary Examiner*—Hien Vu

[57] ABSTRACT

A retainer (10) for use with a card edge connector (1) includes an insulative housing (16) defining a cavity (22) surrounded by a pair of side walls (18) and a pair of end walls (20) with mounting stands integrally formed on its exterior. A pair of towers (26) are formed at two opposite ends of the housing (16) adjacent the end walls (20). Each tower (26) includes a vertical channel (28) for receiving a side edge section (13) of a card (14) which is adapted to be received within the card edge connector (1). A platform (30) extends horizontally and outward on the top of the tower (26). A sliding block (50) is attached onto the platform (30) and defines a first innermost position for locking the card (14) and a second outermost position for allowing loading/unloading of the card (14) with regard to the connector (1). A pair of resilient angularly deflected tangs (38) are positioned on to top surface (40) of the tower (26) for engagement with a first indent (60) and a second indent (61) formed on the underside of the sliding block (50) for orienting the sliding block in the first locking position or in the second free position.

11 Claims, 10 Drawing Sheets

LOCKING DEVICE FOR USE WITH CARD EDGE CONNECTOR

BACKGROUND OF THE INVENTION

1. Field of The Invention

The invention relates to card edge connectors, and particularly to the locking device for use with the card edge connector.

2. The Related Art

Card-like modules are popularly used in the computer industry due to its replaceable character for upgrading. Thus, card edge connectors are also commonly used in the computer set for receiving such card-like modules therein, for example, U.S. Pat. Nos. 4,204,737, 4,349,237, 4,481,612, 4,804,334, 4,826,447, 4,850,891, 4,869,672, 4,898,540, 4,990,097, 5,013,264, 5,026,292, 5,211,571, 5,242,312, 5,407,365, 5,460,537 and 5,494,451. To efficiently hold the card-like module in position in the card edge connector, a pair of latching ejectors are disposed adjacent two opposite ends of the housing of the card edge connector wherein such pair of ejectors can be rotatably moved with regard to the housing for defining a slanted open position for allowing the module to be freely inserted into the connector from the top, and a vertical locking position for latchably retaining the module in the housing of the connector. This type connector is generally called DIMM (Dual In-line Memory Module) connector, for example, U.S. Pat. Nos. 5,162,002, 5,429,523, 5,443,393, 5,445,531 and 5,470,242, Other than the aforementioned one-piece housing with built-in latching means, there is another design as shown in FIG. 1, which discloses a two-piece structure wherein a main housing 1 is enclosed within an outer cover 2, of which a pair of channels 3 positioned at two opposite ends, can guide insertion of the card (not shown) until the bottom edge of the card reaches the slot 4 of the main housing 1.

The aforementioned different type card edge connectors have their respective advantages and disadvantages from different viewpoints. Anyhow, an object of the invention is to provide a retention device which can cooperate with the traditional card edge connector for retaining the inserted card-like module in position with regard to the connector.

Another object of the invention is to provide the retention device which not only simultaneously efficiently latchably confines the inserted card in three dimensions, but also allows easy operation and performs reliable retention thereof.

SUMMARY OF THE INVENTION

According to an aspect of the invention, a retainer for use with a card edge connector includes an insulative housing defining a cavity surrounded by a pair of side walls and a pair of end walls with mounting stands integrally formed on its exterior. A pair of towers are formed at two opposite ends of the housing adjacent the end walls. Each tower includes a vertical channel for receiving a side edge section of a card which is adapted to be received within the card edge connector. A platform extends horizontally and outward on the top of the tower. A sliding block is attached onto the platform and defines a first innermost position for locking the card and a second outermost position for allowing loading/unloading of the card with regard to the connector.

A pair of resilient angularly deflected tangs are positioned on to top surface of the tower for engagement with a first indent and a second indent formed on the underside of the sliding block for orienting the sliding block in the first locking position or in the second free position.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
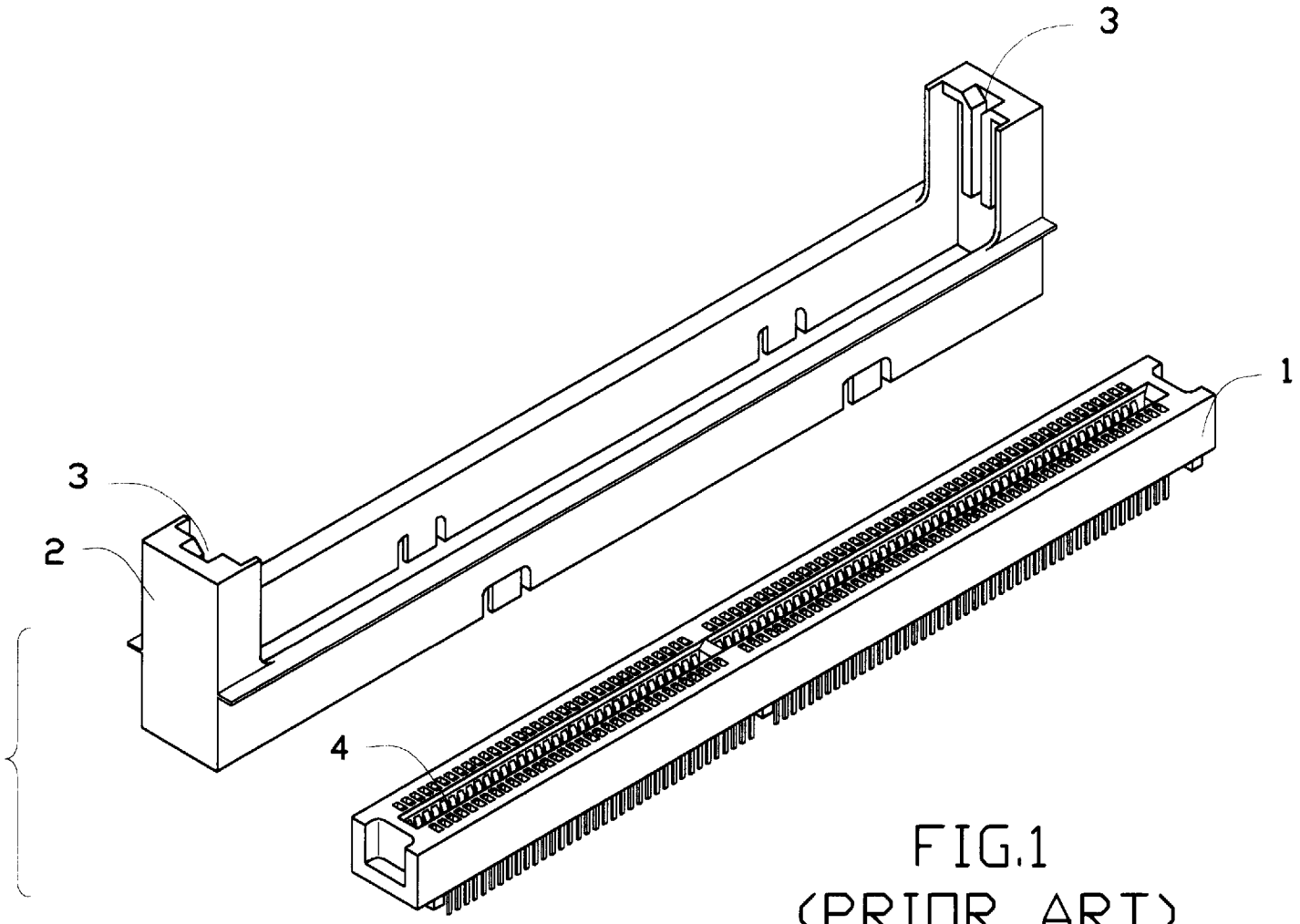
FIG.1 (PRIOR ART)
FIG. 1 is an exploded perspective view of the card edge connector with an outer cover according to the prior art.
Figure 2:
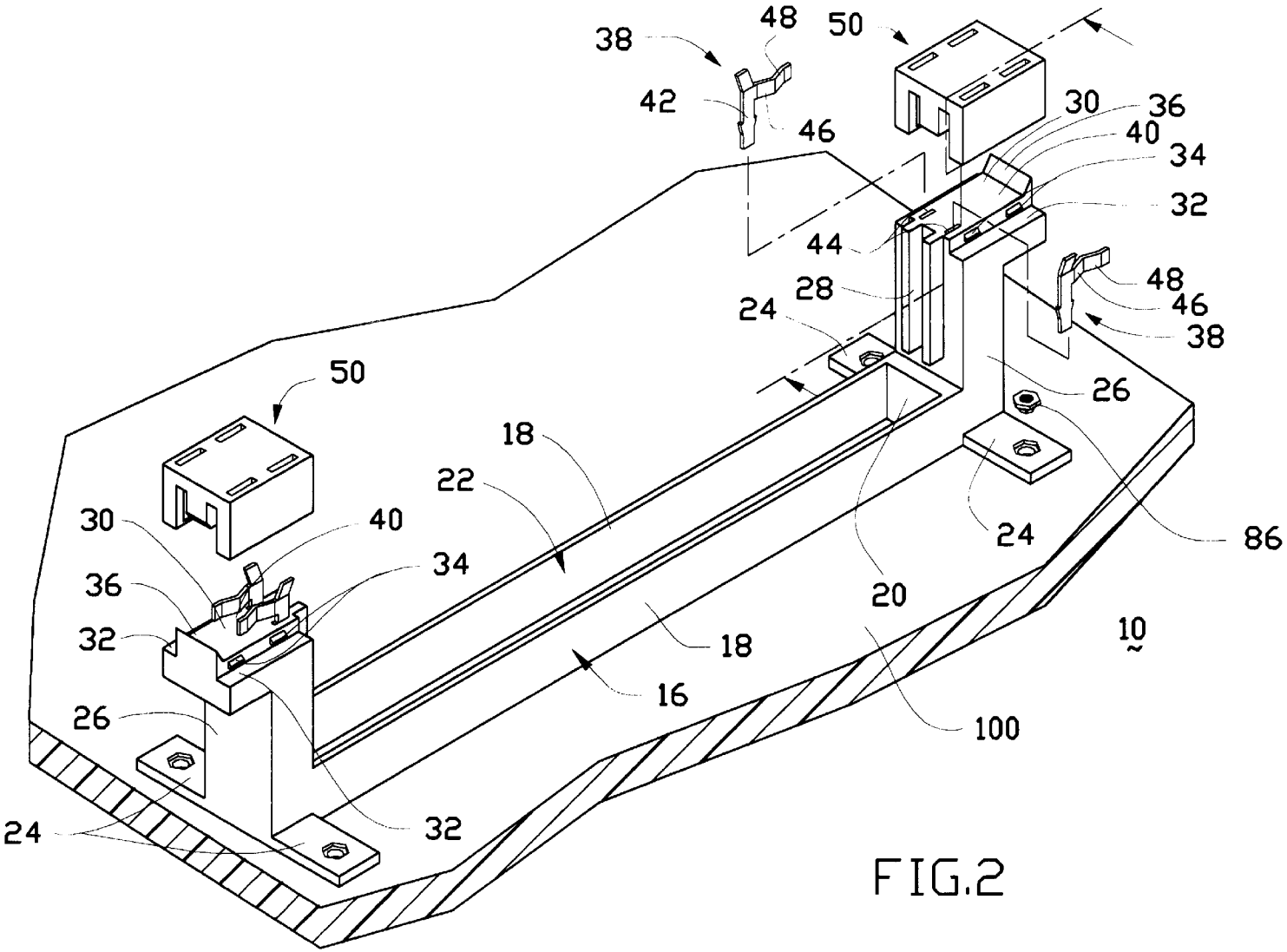
FIG. 2 is an exploded perspective view of a presently preferred embodiment of a retainer for use with a card edge connector according to the invention.
Figure 3:
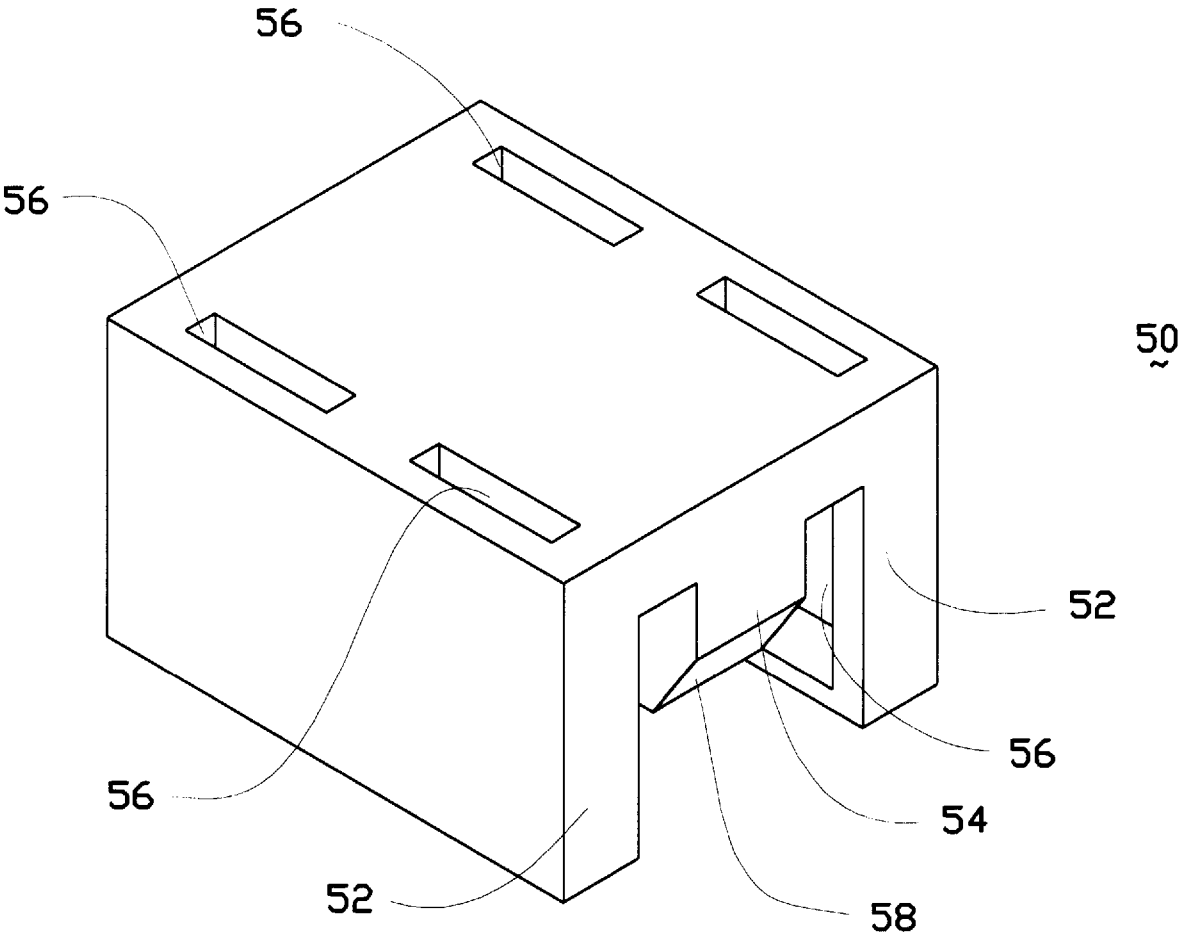
FIG. 3 is an enlarged perspective view of the sliding block of FIG. 2.
Figure 4:
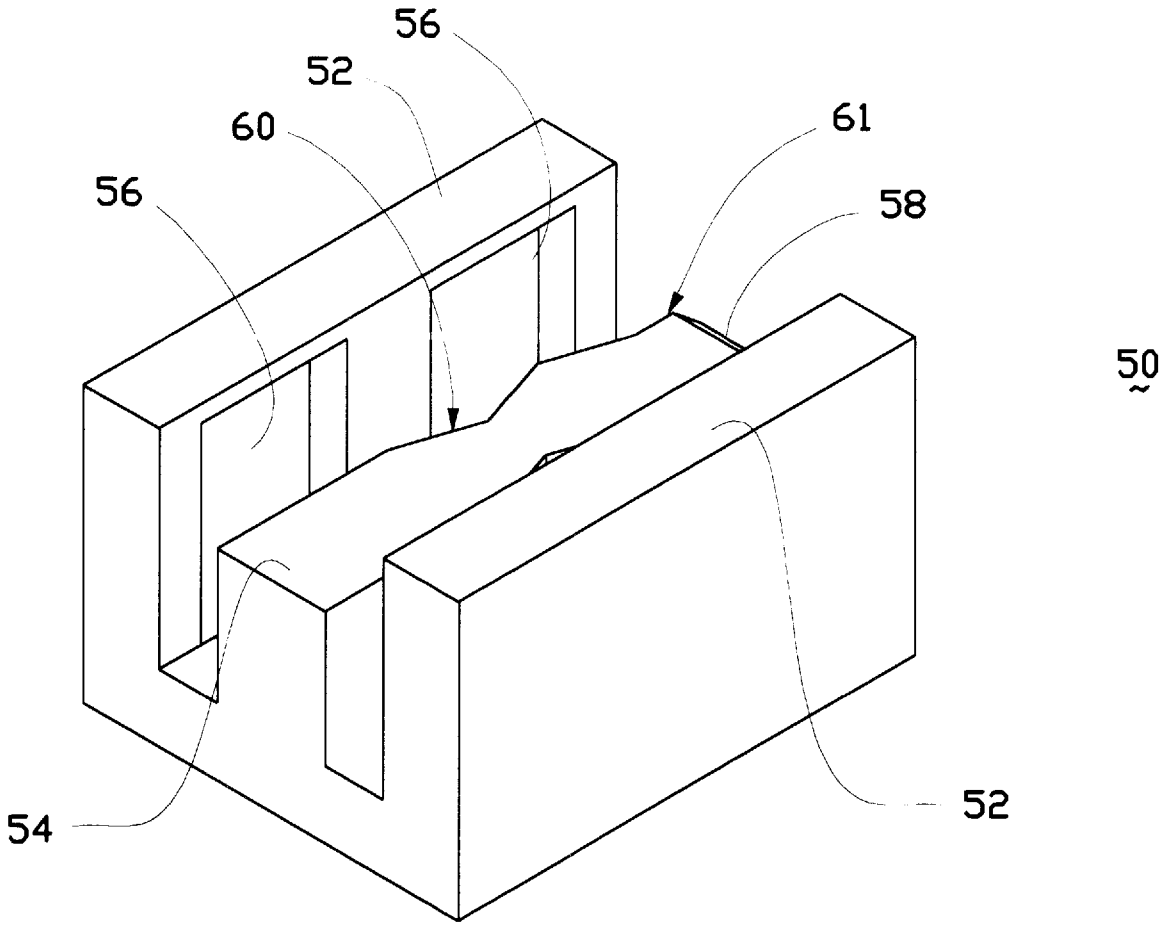
FIG. 4 is an upside-down perspective view of the sliding block of FIG. 3.
Figure 5:
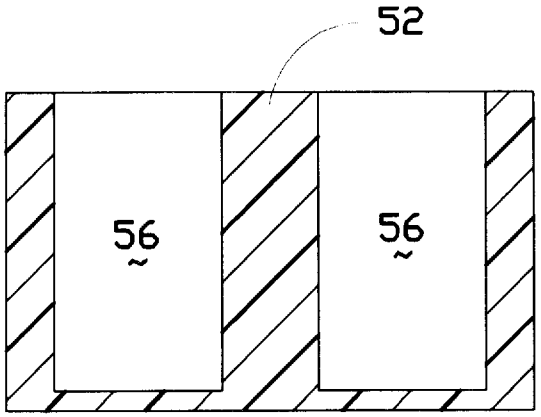
FIG. 5 is a cross-sectional view of the sliding block of FIG. 3 taken along line 3—3.

It will be noted here that for a better understanding, most of like components are designated by like reference numerals throughout the various figures in the embodiments. Attention is directed to FIGS. 2–5 wherein a retainer 10 for use with a card edge connector 1 as shown in FIG. 1 for receiving a card 14 (FIGS. 6 and 7) therein.

The retainer 10 includes a main body 16 consisting of a pair of opposite longitudinal side walls 18 and a pair of opposite end walls 20 commonly defining a cavity 22 for receiving the connector 1 therein. Two pair of laterally extending stands 24 are formed at two opposite ends of the main body 16 for mounting the retainer 10 on a PC board 100 by means of the fastening device 80 which will be described in detail later.

Figure 6:
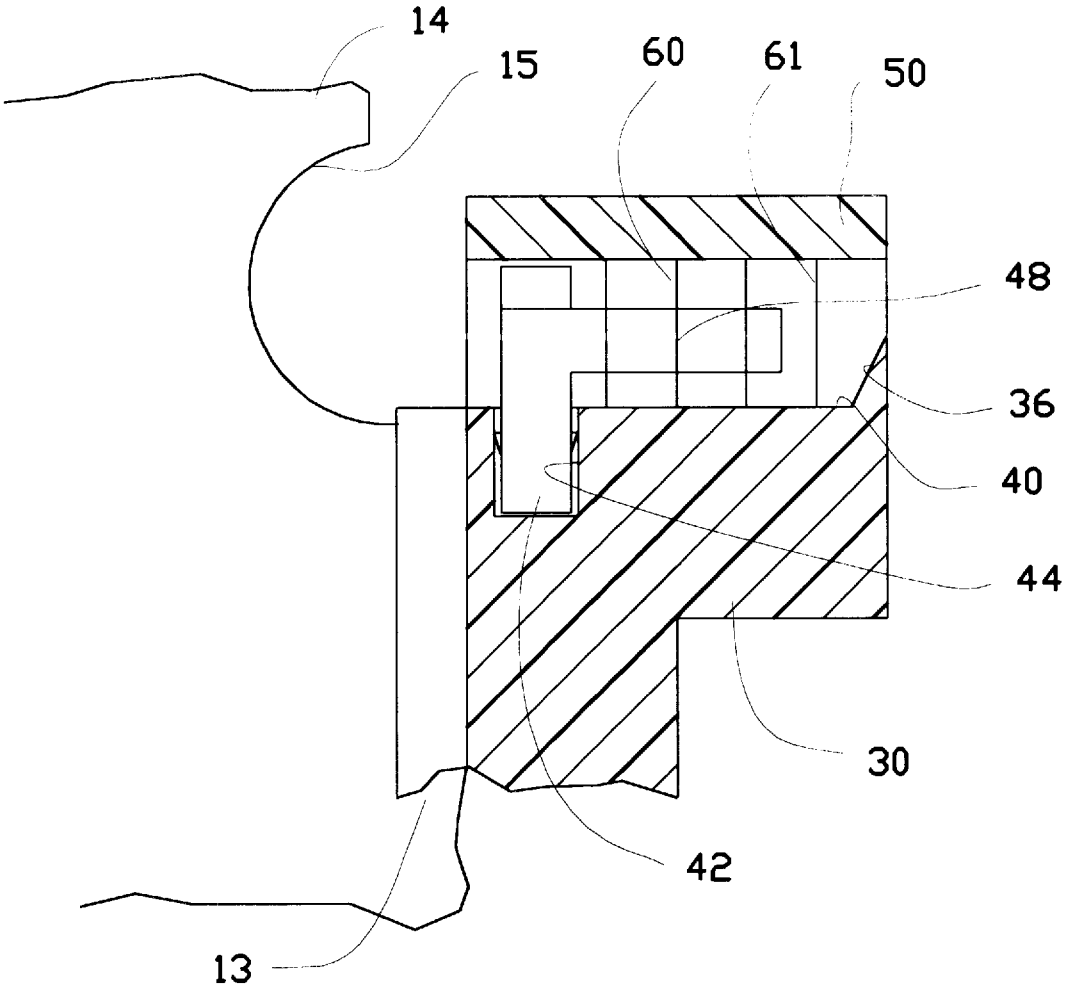
FIG. 6 is a fragmentary cross-sectional view of the retainer of FIG. 2 with the inserted card wherein the sliding block is in a free outermost position.
Figure 7:
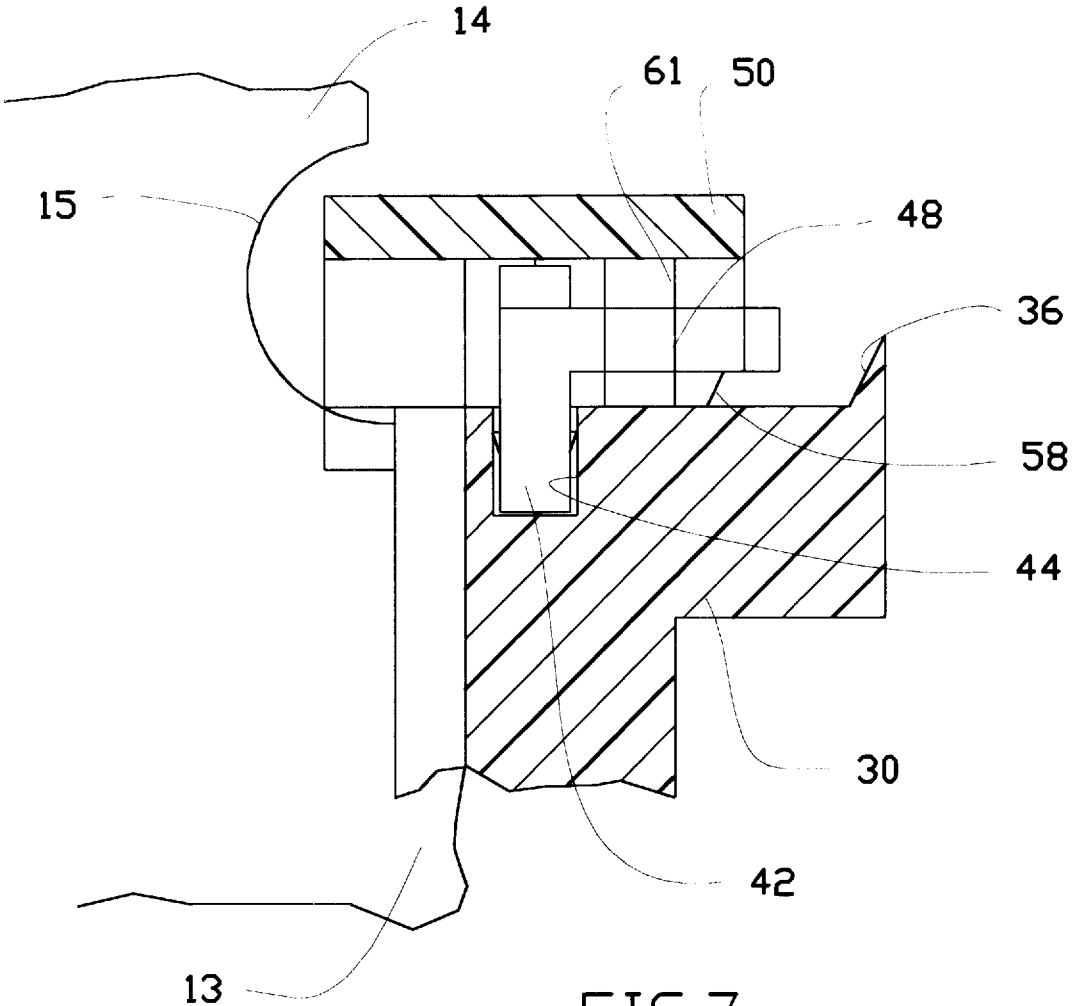
FIG. 7 is a fragmentary cross-sectional view of the retainer of FIG. 2 with the inserted card wherein the sliding block is in a locking innermost position.

A pair of towers 26 extend upward adjacent two opposite ends of the main body 16 each including a vertical channel 28 for guiding and receiving the corresponding side edge section 13 of the card 14 therein (FIG. 6 and 7). A platform 30 extends horizontally and outward at the top of each tower 26 wherein two rails 32 are formed on two sides thereof and a pair of protrusions 34 are formed on each rail 32. A stopper surface 36 is formed on each platform 30.

A pair of resilient angularly deflected tangs 38 are positioned on the top surface 40 of the platform 30 where each tang 38 includes a leg 42 downward extending into a corresponding aperture 44 in the platform 30 with an interference fit, and a horizontally extending spring finger 46 defining an apex 48 thereon for cooperation with a sliding block 50.

The sliding block 50 includes two side portions 52 and an center portion 54 wherein a pair of recesses 56 are formed in each of the side portions 52 for cooperative engagement with the aforementioned protrusions 34 of the platform 30, and the center portion 54 includes an abutting surface 58 for limiting the outward movement of the sliding block 50. The center portion 54 further includes a pair of indents 60, 61 formed on two sides thereof for compliance with the configuration of the apex 48 of the corresponding tang 38.

Also, referring to FIG. 6, the sliding block 50 can be loaded onto the corresponding platform 30 from the top until the protrusions 34 of the platform 30 are engaged within the corresponding recesses 56 in the sliding block 50. Thus, the sliding block 50 can not upward, with regard to the platform 30, move due to engagement of the protrusions 34 in the recesses 56 of the sliding block 50. The sliding block 50 also cannot move outward because of abutment between the abutting surface 58 and the stopper surface 36. The sliding block 50 can not move laterally or downward due to abutment against the platform 30.

In this condition, the apex 48 of each tang 38 is received within the inner indent 60 for maintaining the sliding block 50 in position, and inward movement is the only one way for the sliding block 50 to move.

Referring to FIG. 7, after the card 14 is completely inserted into the connector 1 along the channels 28, the sliding block 50 can be moved inward until the innermost portion of the sliding block 50 is snugly and fully received within the corresponding notch 15 of the card 14. Under this situation, the apex 48 of the tang 38 can be received within the outer indent 61 of the corresponding sliding block 50. Therefore, the sliding block 50 can efficiently hold the inserted card 14 in position without any inadvertent withdrawal of the inserted card 14.

Oppositely, the inserted card 14 can be removed from the retainer 12 and the associated connector 1, if desired, by outward movement of the sliding block 50 from the innermost locking position to its outermost free position.

Figure 9:
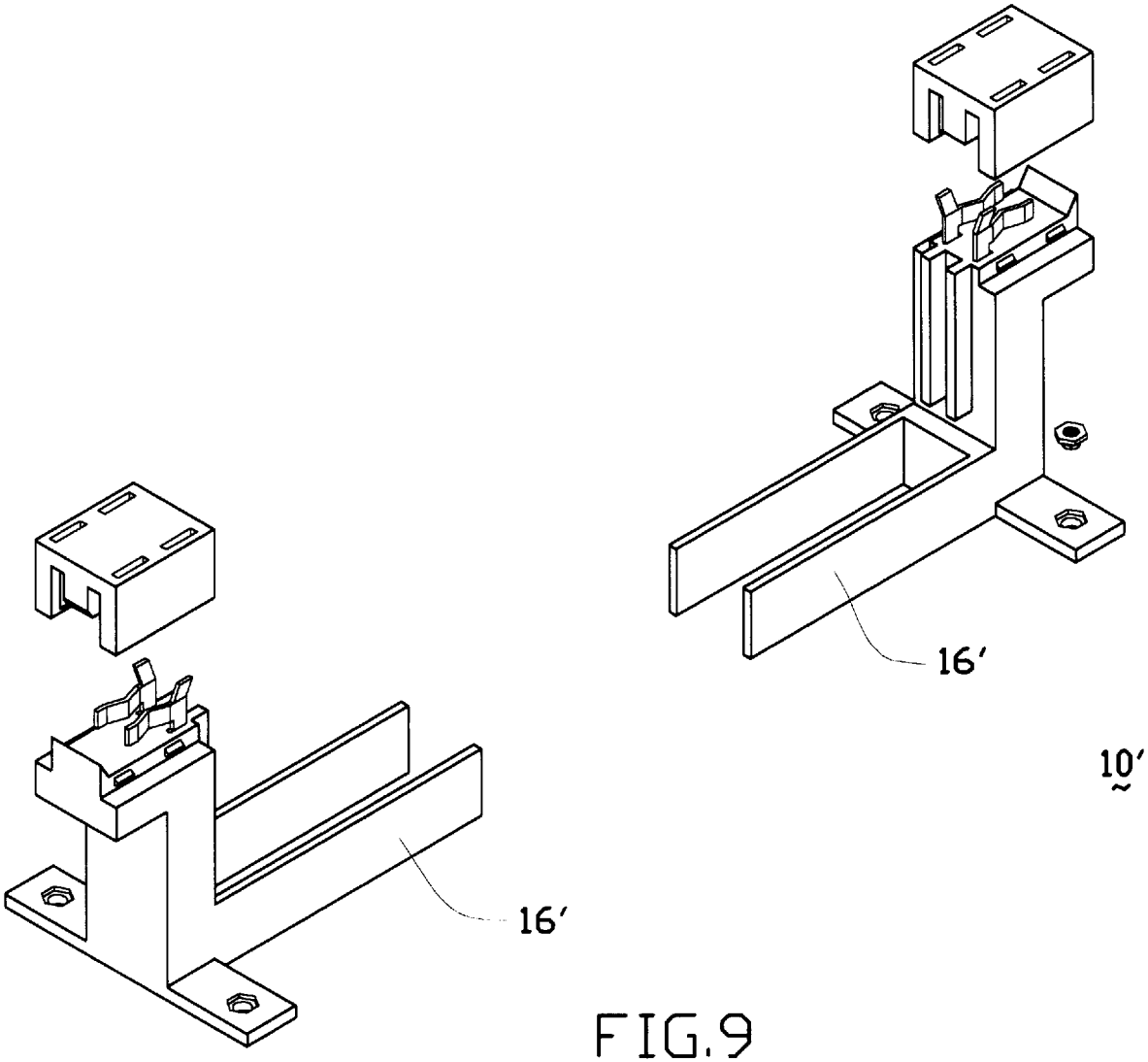
FIG. 9 is a perspective view of a second embodiment of the retainer.
Figure 10:
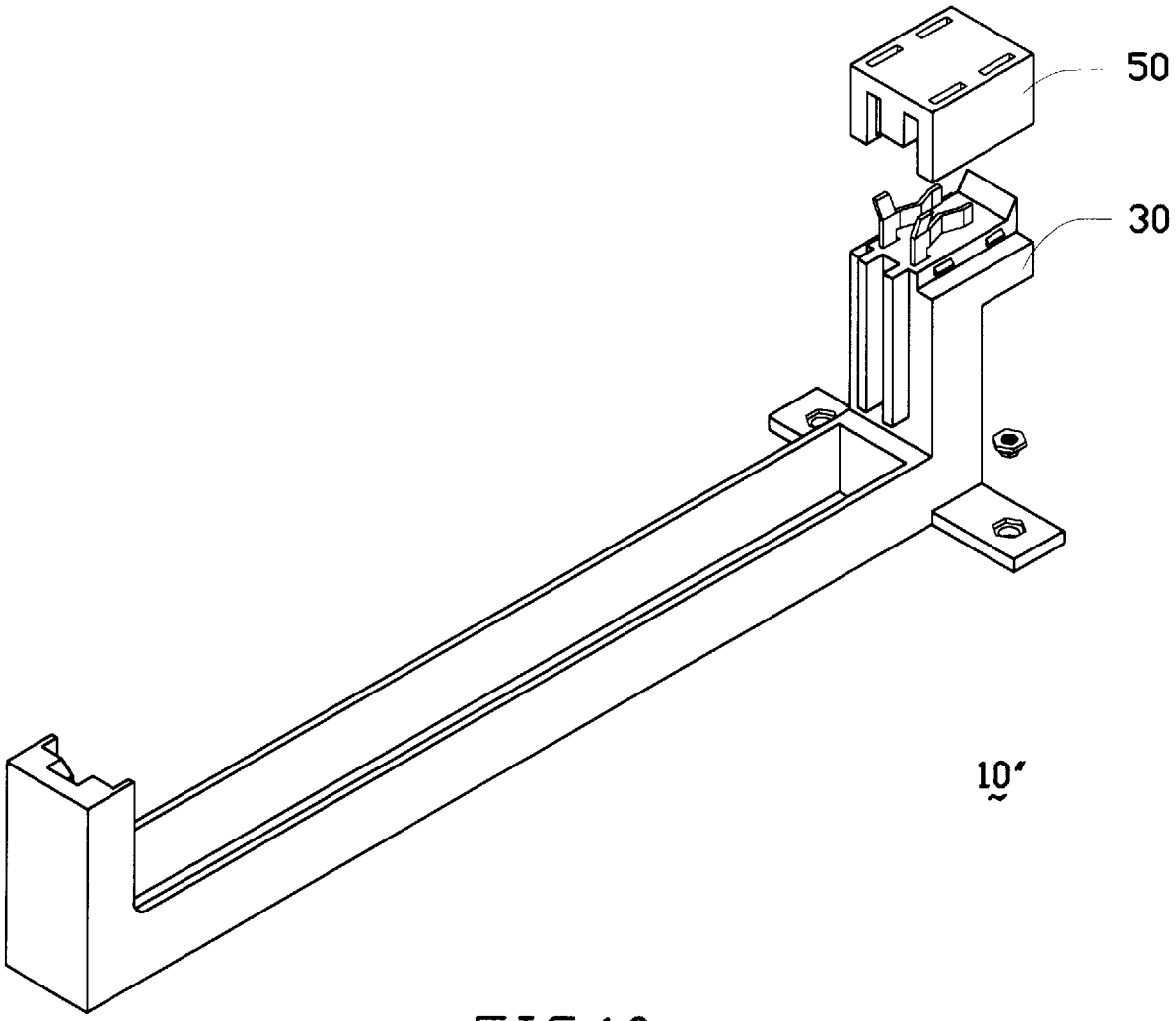
FIG. 10 is a perspective view of a third embodiment of the retainer.

FIG. 9 shows another embodiment of the retainer 10' defining the main body 16 composed of two separate halves 16'. FIG. 10 shows a third embodiment defining only one sliding block 50 and the correspond platform 30 are used for the retainer 10".

Figure 8:
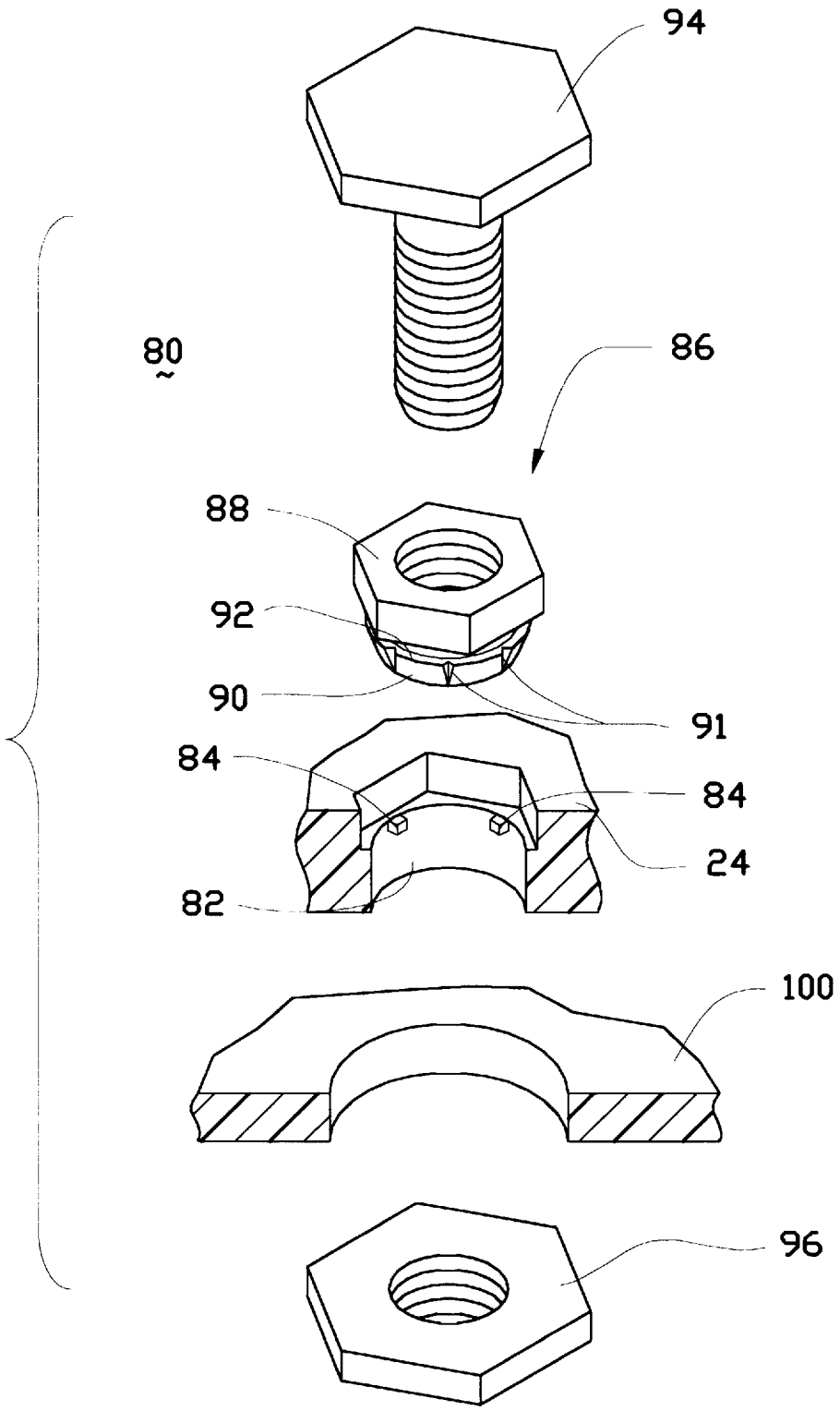
FIG. 8 is a fragmentary perspective view of the retainer of FIG. 2 with the PC board on which the retainer is mounted to show the fastening device thereof.

FIG. 8 discloses the fastening device 80 for use with the retainer 10 wherein the stand 24 defines a countersink 82 with a plurality of projections 84 on its periphery. A screw nut 86 includes an upper large hexagonal section 88, a lower medium round section 90 and a middle small round section 92 therebetween wherein the lower medium round section 90 has some leading cut-aways 91 thereon corresponding to the projections 84. Therefore, the screw nut 86 can be inserted into the countersink 82 through the projections 84 being in alignment with the corresponding cut-aways 91 until such projections 84 pass the lower medium round section 90 and are generally positioned around the middle small round section 92 and sandwiched between the upper hexagonal section 88 and the lower medium round section 90. Thus, the screw nut 86 is fixedly retained in the countersink 82 in the stand 24. Based on this structure, a screw 94 may extend through the screw nut 86 to cooperate with a locking nut 96 for sandwiching the stand 24 of the retainer 10 and the PC board 100 therebetween, thus fastening the retainer 10 to the PC board 100.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. A retainer for use with a card edge connector, comprising:

a main body defining a cavity for receiving said card edge connector therein;

at least a tower positioned adjacent one end of the main body and defining a vertical channel for guiding insertion/withdrawl of a card into/from the retainer;

a platform horizontally extending outward on a top portion of the tower;

a sliding block horizontally slidably mounted on said platform between an innermost first locking position and an outermost second free position, whereby when said sliding block is at the innermost first locking position, the sliding block can be latchably engaged within a notch of said card inserted into the retainer to retain said card in position with regard to the retainer, and when the sliding block is at the outermost second free position, said card is allowed to be inserted/withdrawn into/from the retainer without any improper interference; and locating means disposed on the platform and the sliding block for locating the sliding block at the first and second positions.

2. The retainer as defined in claim 1, wherein said locating means includes a pair of resilient tangs disposed on the platform and two pairs of indents formed in the sliding block.

3. The retainer as defined in claim 1, wherein said locating means further includes a stopper surface on the platform and an abutment surface on the sliding block, said stopper surface engaging the abutment surface when the sliding block is at the outermost second free position.

4. The retainer as defined in claim 1 further including several stands having fastening devices thereon for securing the retainer to a PC board.

5. An electrical assembly for retaining a card on a PC board, comprising:

a main body defining a space for receiving said card therein;

at least a tower positioned adjacent one end of the main body for confining a lengthwise movement of said card received in the main body;

a sliding block disposed on the tower and slidably movable with regard to the main body in a horizontal direction between an innermost first locking position and an outermost second free position, whereby when the sliding block is located at the innermost first locking position, the sliding block is engaged within a notch of said card received in the main body for locking the card in the main body, and when the sliding block is located at the outermost second free position, the sliding block is disengaged from said notch of said card for releasing the card from the main body; and first locating means provided on the sliding block and second locating means provided on the tower, said first and second locating means cooperating to locate the sliding block at the first and second positions.

6. The assembly as defined in claim 5, wherein said first locating means includes at least two indents and said second locating means includes at least a resilient angularly deflected tang.

7. A retainer for use with a card edge connector, comprising:

a main body defining a cavity for receiving said card edge connector therein;

at least a tower positioned adjacent one end of the main body and defining a vertical channel for guiding insertion/withdrawl of a card into/from the retainer;

a platform horizontally extending outward on a top portion of the tower;

a sliding block slidably mounted on said platform between an innermost first locking position and an outermost second free position, whereby when said sliding block is at the innermost first locking position, the sliding block can be latchably engaged within a notch of said card inserted into the retainer to retain said card in position with regard to the retainer, and when the sliding block is at the outermost second free position, said card is allowed to be inserted/withdrawn into/from the retainer without any interference; and locating means disposed on the platform and the sliding block for locating the sliding block at the first and second positions, wherein said locating means comprises a pair of resilient tangs disposed on the platform and two pairs of indents formed in the sliding block.

8. The retainer as defined in claim 7, wherein the locating means further comprises a stopper surface on the platform and an abutment surface on the sliding block, said stopper surface engaging the abutment surface when the sliding block is at the outermost second free position.

9. The retainer as defined in claim 7 further comprising several stands having fastening devices thereon for securing the retainer to a PC board.

10. An electrical assembly for retaining a card on a PC board, comprising:

a main body defining a space for receiving said card therein;

at least a tower positioned adjacent one end of the main body for confining a lengthwise movement of said card received in the main body; and a sliding block disposed on the tower and slidably movable with regard to the main body in a horizontal direction between an innermost first locking position and an outermost second free position, whereby when the sliding block is located at the innermost first locking position, the sliding block is engaged within a notch of said card received in the main body for locking the card in the main body, and when the sliding block is located at the outermost second free position, the sliding block is disengaged from said notch of said card for releasing the card from the main body; and at least two indents defined in the sliding block and at least a resilient angularly deflected tang fixed on the tower, said two indents and said tang cooperating to locate the sliding block at the innermost first locking position and the outermost second free position.

11. A retainer for use with a card edge connector, comprising:

a main body defining a cavity for receiving said card edge connector therein;

at least a tower positioned adjacent one end of the main body and defining a vertical channel for guiding insertion/withdrawl of a card into/from the retainer;

a platform horizontally extending outward on a top portion of the tower; and a sliding block horizontally slidably mounted on said platform between an innermost first locking position and an outermost second free position, whereby when said sliding block is at the innermost first locking position, the sliding block can be latchably engaged within a notch of said card inserted into the retainer to retain said card in position with regard to the retainer, and when the sliding block is at the outermost second free position, said card is allowed to be inserted/withdrawn into/from the retainer without any interference.

* * * * *